US006354186B1

(12) United States Patent
Gibson et al.

(10) Patent No.: US 6,354,186 B1
(45) Date of Patent: Mar. 12, 2002

(54) HYDROSTATIC THRUST BEARING FOR A WOBBLE PLATE PUMP

(75) Inventors: Dennis H. Gibson, Chillicothe; Mark F. Sommars, Sparland, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/450,887

(22) Filed: Nov. 29, 1999

Related U.S. Application Data

(60) Provisional application No. 60/111,387, filed on Dec. 8, 1998.

(51) Int. Cl.[7] ..... F01B 3/00
(52) U.S. Cl. ..... 92/71; 92/157
(58) Field of Search ..... 92/157, 159, 71; 91/499; 74/60

(56) References Cited

U.S. PATENT DOCUMENTS

| | | | | |
|---|---|---|---|---|
| 1,714,145 A | | 5/1929 | Sperry | |
| 2,169,456 A | | 8/1939 | Wahlmark | |
| 2,405,938 A | | 8/1946 | Beeh | |
| 2,518,618 A | | 8/1950 | Huber | |
| 2,549,711 A | | 4/1951 | Ruben | |
| 2,821,932 A | | 2/1958 | Lucien | |
| 2,918,012 A | | 12/1959 | Lucien | |
| 3,257,960 A | | 6/1966 | Keel | |
| 3,304,884 A | | 2/1967 | Kouns | |
| 3,761,202 A | | 9/1973 | Mitchell | 417/269 |
| 3,768,377 A | | 10/1973 | Engel et al. | |
| 3,933,082 A | | 1/1976 | Molly | 91/499 |
| 4,584,927 A | | 4/1986 | Mourrier et al. | |
| 4,644,850 A | | 2/1987 | Kanamaru et al. | 417/269 |
| 4,911,063 A | | 3/1990 | Kawahara et al. | 92/71 |
| 5,279,205 A | * | 1/1994 | Carlson, Jr. et al. | 91/499 |
| 5,423,183 A | | 6/1995 | Folsom | |
| 5,601,009 A | | 2/1997 | Jepsen et al. | 92/71 |
| 5,738,000 A | | 4/1998 | Forster | |

FOREIGN PATENT DOCUMENTS

| | | | |
|---|---|---|---|
| EP | 0 301 229 | | 2/1989 |
| FR | 87.438 | | 6/1966 |
| JP | 08159237 A | * | 6/1996 |

* cited by examiner

*Primary Examiner*—Edward K. Look
*Assistant Examiner*—Thomas E. Lazo
(74) *Attorney, Agent, or Firm*—Eric M. Bram; Alan J. Hickman

(57) ABSTRACT

A displacement pump has a rotatable drive shaft and at least one piston containing a piston cavity, and a piston shoe flexibly connected with the piston. The piston shoe comprises a shoe passage fluidly connected with the piston cavity. The displacement pump also has a hydrostatic thrust bearing plate comprising at least one thrust pad, and a driveplate connected with the drive shaft and disposed between the piston shoe and the thrust pad. The driveplate comprises a bearing surface proximate to the thrust pad, a pumping surface proximate to the piston shoe, and at least one communication port fluidly connecting the bearing surface with the pumping surface. The driveplate is rotatable to a position in which the piston cavity is fluidly connected with the thrust pad via the shoe passage and the communication port.

4 Claims, 4 Drawing Sheets

HYDROSTATIC THRUST BEARING FOR A WOBBLE PLATE PUMP

RELATION TO OTHER PATENT APPLICATIONS

This application claims the benefit of prior provisional application Ser. No. 60/111,387 filed Dec. 8, 1998.

TECHNICAL FIELD

The present invention relates generally to pumps and hydraulically-actuated systems used with internal combustion engines, and more particularly to axial hydraulic pumps with wobble plates.

BACKGROUND ART

Hydraulic pumps that utilize wobble plates to drive reciprocating pistons are susceptible to wear. The wobble plate is usually the driveplate with a tilted pumping surface that pushes against the pump's pistons. As the driveplate rotates each piston is pushed away from the driveplate as the thickness of the driveplate beneath it becomes greater with the rotation, causing the piston to compress. The hydraulic pressure within the piston increases as the volume within the piston decreases. This high pressure hydraulic fluid is generally the output product of the hydraulic pump. As rotation continues and the thickness of the driveplate beneath the piston lessens, the higher hydraulic pressure within the piston allows it to expand again and refill itself with lower pressure hydraulic fluid.

There is generally friction between the driveplate and the piston as the driveplate rotates. This can cause wear to the piston and driveplate surfaces. Additionally, there is generally friction and wear against other surfaces that the rotating driveplate comes in contact with, as well.

Of course, the driveplate and whatever holds it must also be capable of bearing the loads caused by pushing against the compressing pistons. These loads may be axial (i.e., parallel to the drive shaft axis and/or perpendicular to the plaintiff rotation of the driveplate) or radial (i.e., perpendicular to the drive shaft axis), or some combination thereof.

DISCLOSURE OF THE INVENTION

A displacement pump 1 according to one aspect of the invention has a rotatable drive shaft 9 and at least one piston 20 containing a piston cavity 62, and a piston shoe 34 flexibly connected with the piston 20. The piston shoe 34 comprises a shoe passage 60 fluidly connected with the piston cavity 62. The displacement pump also has a hydrostatic thrust bearing plate 40 comprising at least one thrust pad 42, and a driveplate 12 connected with the drive shaft 9 and disposed between the piston shoe 34 and the thrust pad 42. The driveplate 12 comprises a bearing surface 46 proximate to the thrust pad 42, a pumping surface 38 proximate to the piston shoe 34, and at least one communication port 48 fluidly connecting the bearing surface 46 with the pumping surface 38. The driveplate 12 is rotatable to a position in which the piston cavity 62 is fluidly connected with the thrust pad 42 via the shoe passage 60 and the communication port.

BEST MODE FOR CARRYING OUT THE INVENTION

Figure 1:
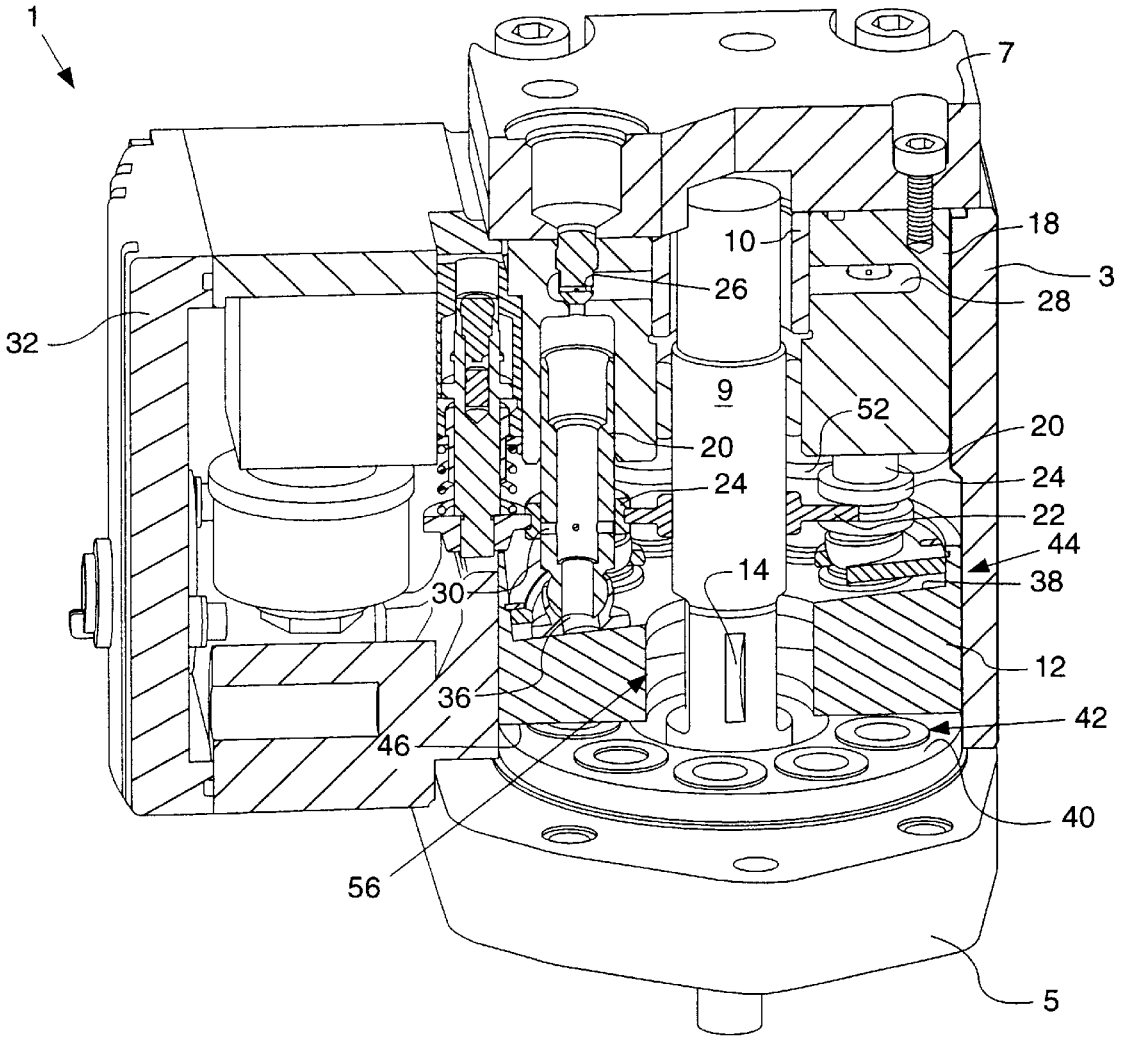
FIG. 1 is a combination perspective and cross-sectional diagrammatic view of a fixed displacement pump according to the invention.

With reference to FIGS. 1–4, a pump 1 utilizing the hydrostatic bearing and driveplate 12 configuration of the invention comprises a housing 3 between a front flange 5 and an end cap 7. A drive shaft 9 driven by an engine (not shown) extends into the pump 1, supported by a bearing collar 10 or needle. The drive shaft 9 in this embodiment is connected with a wobble plate type driveplate 12 in a keyway drive configuration in which a key (not shown) fits into a drive shaft slot 14 and a driveplate slot 16 in the driveplate 12. Other configurations utilizing the invention are possible, but a keyway drive or other configuration that allow the driveplate 12 to rotate nonrigidly is preferred.

A barrel 18 bolted to the end cap 7 holds a number of pistons 20 (nine in this embodiment) that are connected to one another by a connector 22. Each piston 20 is slidably held within a respective sleeve 24. A one-way outlet check nozzle 26 at the top end of each piston 20 allows compressed hydraulic fluid to exit each piston 20 into a collector ring 28 of high pressure hydraulic fluid for output from the pump 1.

Bleed holes 30 are situated in each piston 20 in the area of its respective sleeve 24. An electro-hydraulic control unit 32 can control the vertical position of each sleeve 24 on its respective piston 20, to control discharge of the pump 1 by selectively allowing the sleeves 24 to cover or uncover the bleed holes 30 during a variable portion of piston 20 compression.

Each piston 20 is connected with a respective piston shoe 34 by means of a flexible joint, a ball joint 36 for example, so that the piston shoes 34 can conform to the slanted pumping surface 38 of the driveplate 12 as it rotates. The driveplate 12 in turn rests against a hydrostatic thrust bearing plate 40 on the front flange 5. The hydrostatic thrust bearing plate 40 comprises a number of thrust pads 42, each positioned directly beneath a respective one of the pistons 20. Hydraulic fluid (e.g., engine oil) from within the interior 52 of the pump 1 forms a hydrodynamic journal bearing 44 between the driveplate 12 and the housing 3 as the driveplate 12 rotates.

Figure 2:
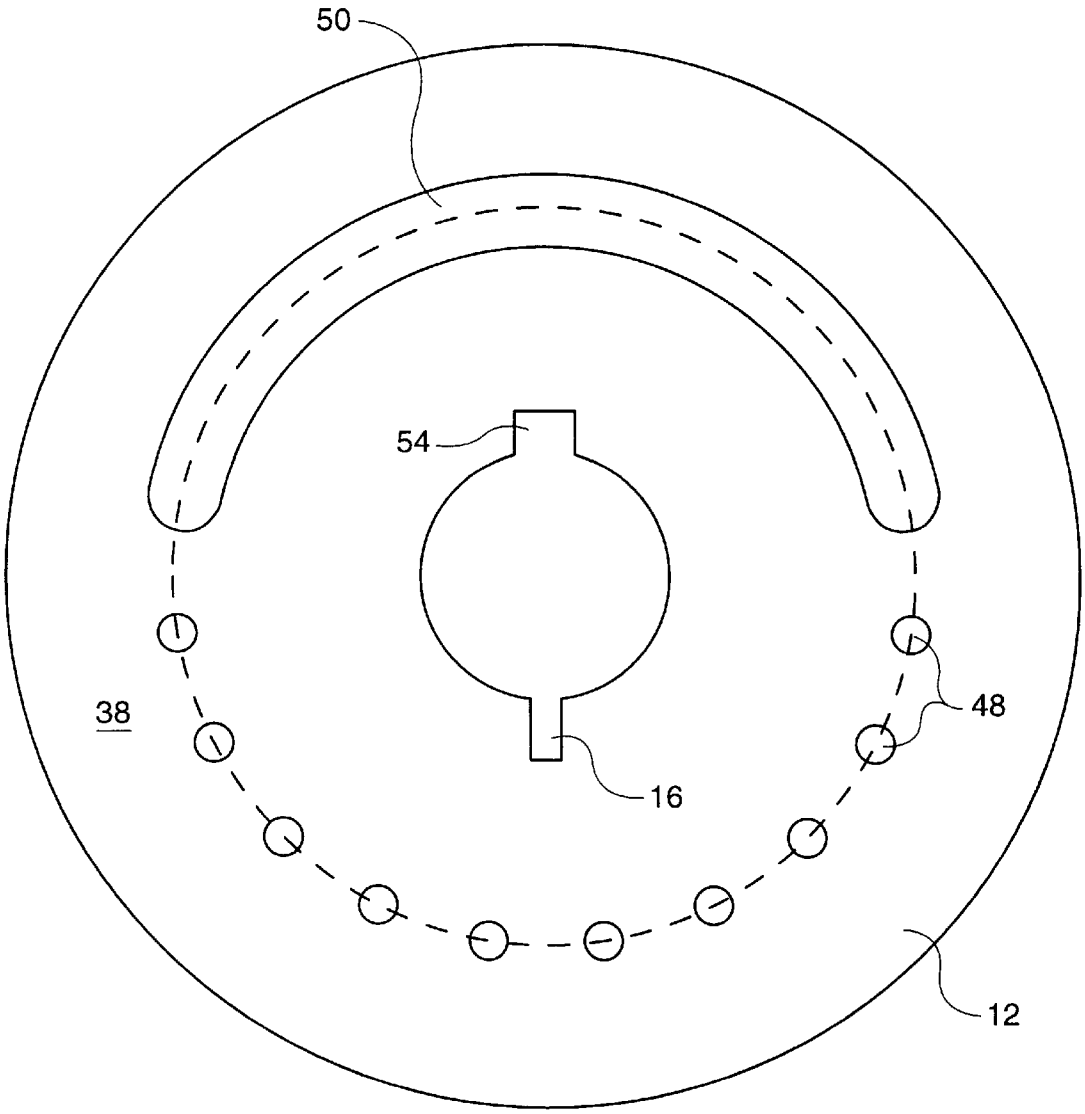
FIG. 2 is a top view of the driveplate of the pump of FIG. 1.
Figure 3:
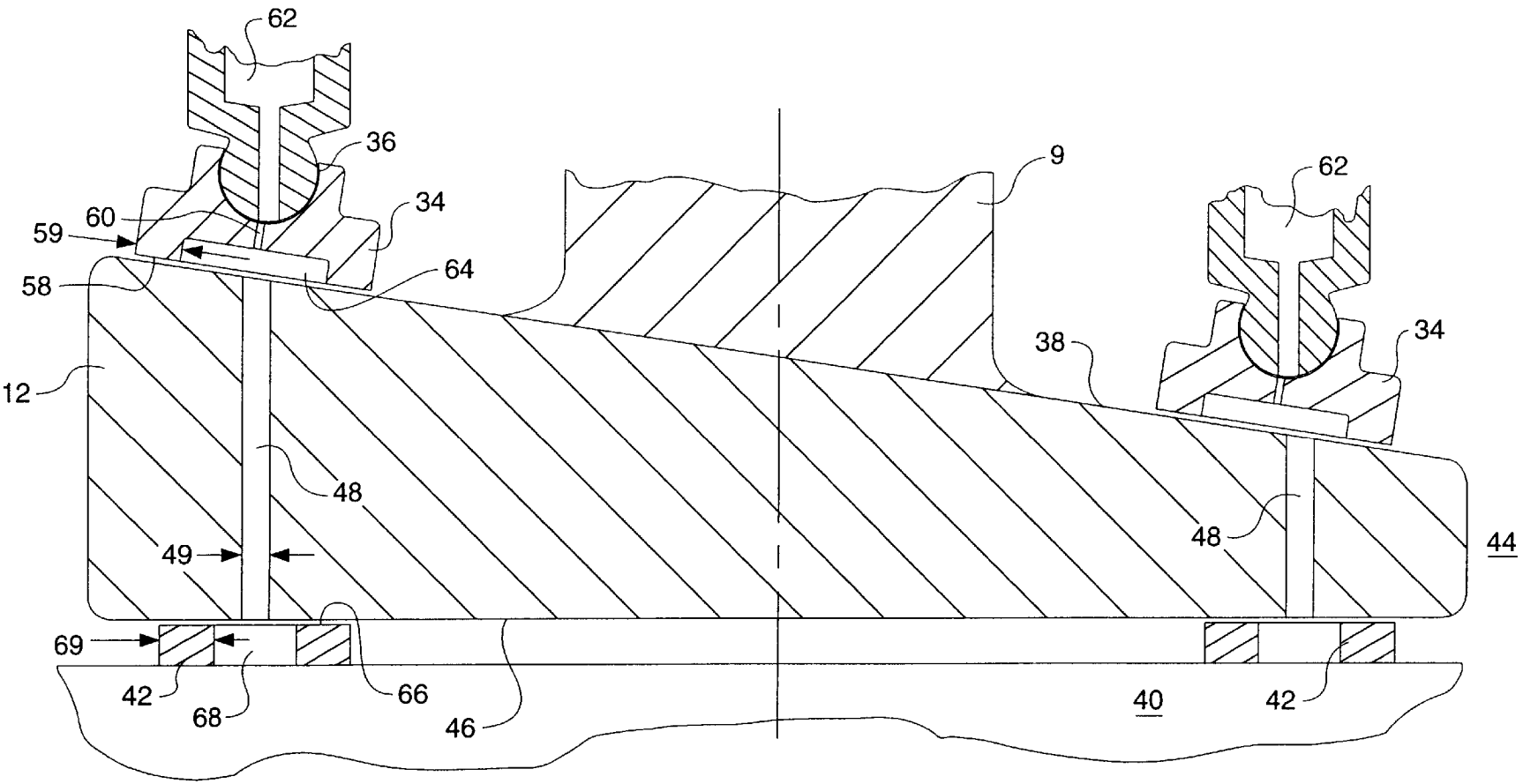
FIG. 3 is a cross sectional view of a driveplate portion of the pump of FIG. 1.

With reference mostly to FIGS. 2 and 3, the driveplate 12 has a bearing surface 46 and the pumping surface 38. The driveplate 12 contains several communication ports 48 that pass through the driveplate 12 between the pumping surface 38 and the bearing surface 46. The communication ports 48 define a predetermined diameter 49. The communication ports 48 of this embodiment are generally parallel with the drive shaft 9. However, other communication port 48 configurations may be used, such as non-parallel, flared, and frustroconical.

A fill slot 50 is formed in the pumping surface 38 and is always open to a low pressure hydraulic fluid area 52 within the pump 1, for example via a fill notch 54 connected with an inner fill cavity 56, and/or other openings permitting entrance of the low pressure hydraulic fluid to the fill slot 50, for example access ports (not shown) through the bearing surface 46.

Each piston shoe 34 has a flat shoe sill 58 for engaging the driveplate 12 and a shoe passage 60 that allows hydraulic fluid from a piston cavity 62 within the piston 20 to pass to a hydrostatic bearing shoe area 64. Each shoe sill 58 has a predetermined width 59 that corresponds in magnitude to the diameter 49 of the communication port 48. It is well known in the art to determine the hydrostatic bearing shoe area 64 by estimating an effective force diameter (not shown) that is generally equal to the bearing shoe area 64 plus half the predetermined width 59 of the shoe sills 58, i.e mean diameter of the shoe sill. The effective force diameter is at least 90% of the piston diameter (not shown) and preferably between 96% to 98% of the piston diameter.

Similarly, each thrust pad 42 has a thrust pad sill 66 and a hydrostatic bearing pad area 68. Each hydrostatic bearing pad area 68 has a second predetermined width 69 that corresponds in magnitude to the diameter 49 of the communication port 48. It is well known in the art to determine the hydrostatic bearing pad area 68 by estimating an effective force diameter (not shown) that is generally equal to the bearing pad area 68 plus half the second predetermined width 69 of the thrust pad sills 66, i.e. the mean diameter of the thrust pad sills 66. The effective force diameter is at least 90% of the piston diameter and preferably between 96% to 98% of the piston diameter. It should also be recognized that the thrust pad 42 may be located on the bearing surface of the drive plate without departing from the spirit of the invention.

INDUSTRIAL APPLICABILITY

The keyway drive or other nonrigid rotation drive arrangement allows the drive shaft 9 to rotate the driveplate 12 in a nonrigid manner. The rotation of the driveplate 12 causes the pistons 20 to reciprocate up and down. The pistons 20 are connected with the piston shoes 34 that engage the driveplate 12 by ball joints 36, which allows the pistons 20 to maintain a vertical alignment. The axial loads caused by the pistons 20 pushing on the driveplate 12 are balanced by the thrust pads 42, as described below. Because the pumping surface 38 is tilted there are some radial loads, but the radial loads are small, and are easily handled by the hydrodynamic journal bearing 44 that forms between the driveplate 12 and the housing 3 as the driveplate 12 rotates.

As the drive shaft 9 rotates to push a piston 20 up, the communication ports 48 pass between the hydrostatic bearing shoe area 64 of the piston shoe 34 and the hydrostatic bearing pad area 68 of the thrust pad 42 beneath the piston 20. When this occurs high pressure hydraulic fluid from the piston 20 being compressed immediately flows into both the hydrostatic bearing shoe area 64 and the hydrostatic bearing pad area 68.

This allows the piston shoe 34 and the thrust pad 42 to act as hydrostatic bearings to support the thrust forces, since the hydraulic fluid pressure in the hydrostatic bearing areas 64, 68 are equal and match the axial piston load. By means well known in the art, the surface areas of the shoe sills 58 and of the thrust pad sills 66 can be chosen so that hydraulic fluid from the hydrostatic bearing areas 64, 68 flows to form nearly frictionless fluid buffers between the shoe sill 58 and driveplate 12, and between the thrust pad sill 66 and driveplate 12, respectively. For example, good results are obtained when the mean diameter of each shoe sill 58 and pad sill 66 are at least 90% of the piston diameter and preferably between 96% to 98% of the piston diameter.

Figure 4:
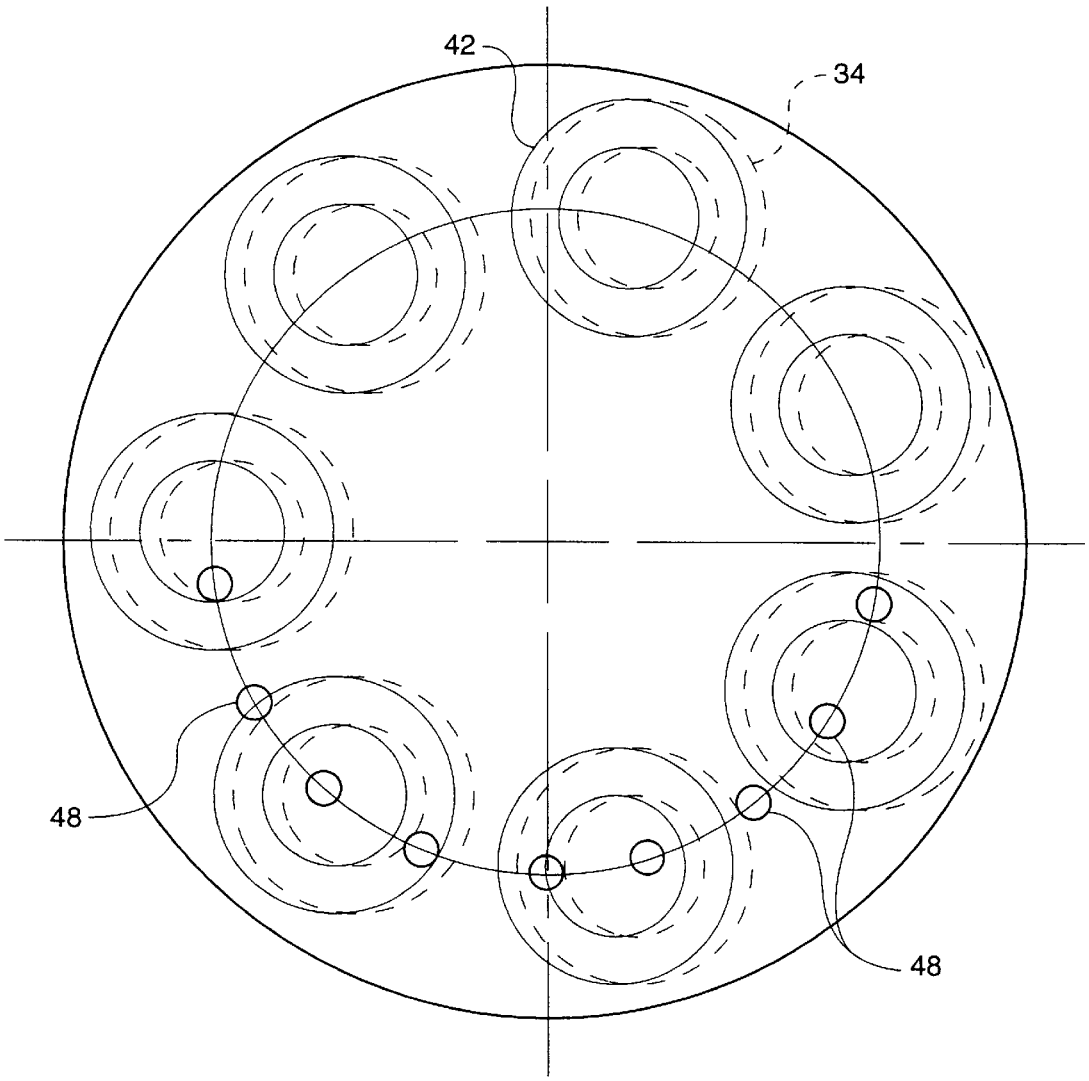
FIG. 4 is a projectional view of one possible placement configuration for proper alignment of piston shoes, thrust pads, and communication ports according to the invention.

As can be seen in FIG. 4, the communication ports 48 are situated in the driveplate 12 such that whenever a piston 20 is being pushed upward, pressurizing hydraulic fluid for pumping, there is always at least one communication port 48 connecting that piston's shoe 34 with its corresponding thrust pad 42. This creates the balanced hydrostatic bearing supporting the thrust on both sides of the driveplate 12.

Further, the strength of each hydrostatic bearing varies to accommodate the variable axial forces generated as the pistons 20 are vertically displaced, because the pressure in the hydrostatic bearing areas 64, 68 is always equal to the pressure within the piston cavity 62. Thus, most of the axial load caused by each piston 20 is carried by the thin film of hydraulic fluid between its piston shoe 34 and the driveplate 12, and by the thin film of hydraulic fluid between the corresponding thrust bearing and the driveplate 12. These thin films of hydraulic fluid keep friction, and therefore wear, to a minimum.

Meanwhile, the high pressure hydraulic fluid in the piston cavity 62 can pass through the outlet check valve 26 into the collector ring 28 and hence to the pump output (not shown). The electro-hydraulic control unit 32 can adjust the positions of the piston sleeves 24 to control the discharge of the pump 1 by controlling the amount of time the bleed holes 30 are blocked by the sleeves 24 during piston compression.

As the driveplate 12 continues to rotate so that the piston 20 begins to move downward, the hydrostatic bearing shoe area 64 is exposed to the fill slot 50 on the pumping surface 38 of the driveplate 12. The fill slot 50 is always exposed to the low pressure hydraulic fluid within the pump 1, so that as the piston 20 moves downward the piston cavity 62 fills with low pressure hydraulic fluid from the fill slot 50 via the shoe passage 60.

While each piston 20 is directly over its respective thrust pad 42, it's piston shoe 34 is slightly offset because the pumping surface 38 is tilted, as can be understood from the projection view of FIG. 4. For best results, the predetermined width of the shoe sills 58 and the second predetermined width 69 of the thrust pad sills 66 should be at least equal to the diameter 49 of the communication ports 48. Furthermore, the communication ports 48 should be placed so that as the driveplate 12 rotates a communication port 48 opens onto a hydraulic bearing shoe area 64 at the same time it opens onto the corresponding hydraulic bearing pad area 68, as demonstrated in FIG. 4. This allows the pressures in the two hydraulic bearing areas to build up at the same time, so that the loads on each piston shoe 34 and its corresponding thrust bearing remain balanced.

The above description is intended for illustrative purposes only, and is not intended to limit the scope of the present invention in any way. For example, it is possible (although not ideal) for one or both of the piston shoes 34 and the thrust pads 42 to be totally flat with no recess for the hydrostatic bearing areas 64, 68, so that the hydrostatic bearing areas 64, 68 are the sills 58, 66 themselves. Thus, those skilled in the art will appreciate that various modifications can be made to the illustrated embodiment without departing from the spirit and scope of the present invention, which is recited in the claims set forth below.

What is claimed is:

1. A displacement pump, comprising:

a rotatable drive shaft;

a piston having a piston cavity disposed therein;

a piston shoe being pivotally connected to said piston, said piston shoe having a shoe passage in fluid communication with the piston cavity;

a hydrostatic thrust bearing plate having at least one thrust pad;

a drive plate being disposed between the piston shoe and the thrust pad and being connected to the drive shaft, said drive plate having a bearing surface proximate to the thrust pad, a pumping surface proximate to the piston shoe, and a communication port fluidly connecting the bearing surface to the pumping surface, said drive plate being rotatable with the drive shaft to a position at which said piston cavity is in fluid communication with said thrust pad via the shoe passage and the communication port;

said thrust pad having a hydrostatic bearing pad area contiguous to said drive plate and a thrust pad sill surrounding said hydrostatic bearing pad area, said thrust pad sill being engageable with said drive plate.

2. The displacement pump, as set forth in claim 1, wherein said piston having a predetermined diameter and said thrust pad sill having a mean diameter at least 90 percent of the diameter of the piston.

3. The displacement pump, as set forth in claim 2, wherein said thrust pad sill having a mean diameter between 96 percent and 98 percent of the piston diameter.

4. The displacement pump, as set forth in claim 1, wherein said communication port having a predetermined diameter and said thrust pad sill having a predetermined width, said width of the thrust pad sill being at least equal to the predetermined diameter of said communication port.

* * * * *